United States Patent [19]

Turner et al.

[11] 4,207,053

[45] Jun. 10, 1980

[54] IGNITER AND FLAME SENSOR ASSEMBLY FOR GAS BURNING APPLIANCE

[75] Inventors: Jesse H. Turner; Charles L. Kaduk, both of Auburn, Ind.

[73] Assignee: Essex Group, Inc., Fort Wayne, Ind.

[21] Appl. No.: 935,039

[22] Filed: Aug. 18, 1978

[51] Int. Cl.[2] ..... F23Q 9/08

[52] U.S. Cl. ..... 431/59; 431/78; 431/258; 219/267

[58] Field of Search ..... 431/25, 59, 78, 258, 431/191, 46; 219/267, 270; 361/264, 266

[56] References Cited

U.S. PATENT DOCUMENTS

| | | | |
|---|---|---|---|
| 2,454,229 | 11/1948 | Sparrow | 431/59 X |
| 2,726,716 | 12/1955 | Russell | 431/59 X |
| 3,136,353 | 6/1964 | Lloyd | 431/78 |
| 3,362,455 | 1/1968 | Robertshaw | 431/78 |
| 3,569,787 | 3/1971 | Palmer | 219/270 X |
| 3,774,077 | 11/1973 | Raffaelli et al. | 361/266 X |
| 3,823,345 | 7/1974 | Mitts et al. | 219/267 |
| 4,029,936 | 6/1977 | Schweitzer | 219/267 |

*Primary Examiner*—Carroll B. Dority, Jr.
*Assistant Examiner*—Randall L. Green
*Attorney, Agent, or Firm*—Lawrence F. Freiburger; Robert D. Sommer

[57] ABSTRACT

An igniter and flame sensor electrode assembly which is suitable for mounting in a conventional thermocouple bracket in close proximity to a fuel burner so that the assembly can be employed in an ignition system to ignite the burner and sense a flame due to its conductive and/or rectification properties. The assembly is shaped similar to a conventional thermocouple and includes a tubular shaped probe having an ignition port in which the igniter element is mounted and a sleeve therearound which forms the flame sensing electrode. The housing for the igniter and flame sensor electrode is formed in two halves and the electrical connections to the flame sensing electrode and igniter element are made by lead wires located in axial bores within the housing.

8 Claims, 2 Drawing Figures

IGNITER AND FLAME SENSOR ASSEMBLY FOR GAS BURNING APPLIANCE

BACKGROUND OF THE INVENTION

Electrical ignition systems for gas burning appliances are well known in the prior art. Typically, these prior art systems include a control circuit, an igniter controlled by the control circuit which causes ignition of fuel issuing from the burner, and a sensing electrode located in the flame which serves to provide a signal to the control circuit when the flame is established. In the prior art, the flame sensing electrode and resistive igniter element have been separately mounted in close proximity to one another.

It is well known to mount a resistive type igniter element inside a two-piece housing having a port therein as is shown in U.S. Pat. No. 3,569,787. It is also well known to provide a resistive type igniter with a shield to protect the igniter element from abuse and direct flame impingement. Typical U.S. Pat. Nos. disclosing a shielded igniter assembly are 3,823,345 and 4,029,936.

Conventional gas appliances employing a continuously burning pilot have generally utilized a thermocouple mounted upon the same bracket as the pilot burner to sense the pilot flame.

SUMMARY OF THE INVENTION

In one aspect, the invention is a combination igniter flame sensor electrode assembly for use in an electrical ignition system for gas burners which is adapted to fit in a conventional thermocouple mounting bracket. More particularly, the invention includes a two-piece ceramic housing which serves to provide a mounting for the igniter element, the flame sensor electrode and the electrical connections to the flame sensor electrode and igniter element. The igniter element is a silicon carbide fiber which is mounted in a port in the tubular housing and the flame electrode is a stainless steel sleeve mounted upon the housing. Electrical connections to both the flame electrode and igniter element are made by suitable lead wires located in longitudinally extending passageways within the housing.

DETAILED DESCRIPTION OF THE PREFERRED EMBODIMENT OF THE INVENTION

Figure 1:
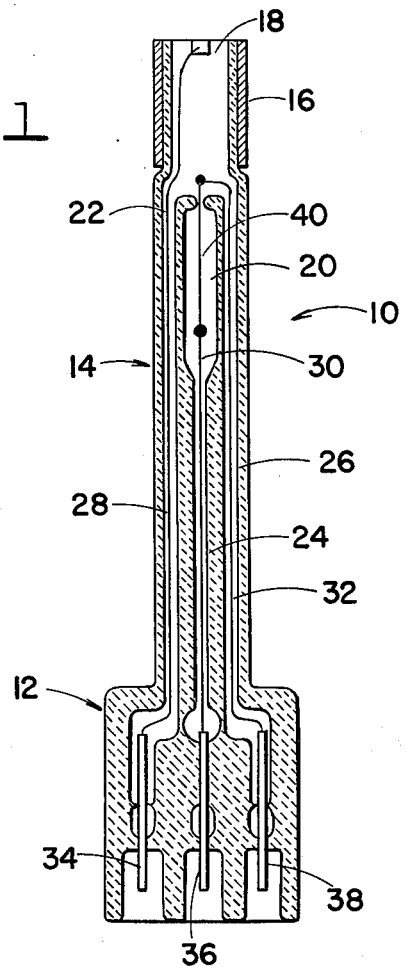
FIG. 1 is a cross-sectional view of a combination igniter-flame sensor assembly in accordance with the present invention.

In accordance with the present invention, the igniter element and flame sensing electrode for an electrical burner ignition system can be incorporated into a single probe shaped unit substantially the size of a conventional thermocouple so that the unit may be mounted on a common bracket with a pilot burner. More particularly, the igniter-flame sensor electrode assembly generally designated in the drawings by reference numeral 10 includes a housing formed of two ceramic housing halves suitably secured together. Preferrably, the housing is circular in cross section and includes an enlarged terminal carrying portion 12 and a probe portion 14 of substantially the same dimensions as a conventional thermocouple so that the assembly may be mounted on a conventional bracket along with a pilot burner. It will be clear to those skilled in the art that any number of mounting methods can be employed in attaching the assembly to the bracket, including but not limited to, spring clips, threaded fasteners and bracket mountings.

A flame sensing electrode is formed by an electrically conductive sleeve 16 surrounding the free hollow end 18 by mechanical means such as crimping or by refractory adhesive. Due to the dissimilarity in thermal expansion characteristics of the stainless steel electrode and the ceramic housing, the mechanical attachment method is preferred because a certain degree of looseness can be tolerated.

An ignition port 20 is formed in the probe portion of the housing preferrably extending completely through the housing at right angles to the axis of the probe portion. In addition, the probe portion of the housing includes three longitudinally extending passageways 22, 24 and 26 therein. It will be noted that passageways 22 and 26 extend into hollow portion 18 and passageway 24 extends into port 20. The passageways 22, 24, and 26 serve to provide a mounting for lead wires 28, 30 and 32, respectively. Lead wire 28 is suitably electrically and mechanically attached to an electric terminal 34 mounted in terminal portion 12 at one end and to conductive sleeve 16 at the other end. In a similar manner, lead wires 30 and 32 are electrically and mechanically secured to electrical terminals 36 and 38, respectively. The other ends of lead wires 30 and 32 are mechanically and electrically attached to opposite ends of a resistive igniter element 40. Preferrably, one end of igniter element 40 is fixed relative to the housing assembly while the opposite end is secured only to its lead wire so as to allow for some expansion and contraction of the igniter element.

The housing is constructed from a suitable refractory material which can withstand the high temperatures caused by the burner flame but yet is able to withstand a reasonable amount of abuse without breaking. STEATITE and alumina are two suitable materials, although those skilled in the art will recognize that other materials may be employed equally as well.

Preferably, the igniter element is a 0.008 inch diameter fiber of silicon carbide approximately 0.4 inch in length. Such a fiber along with a suitable current regulating circuit to provide a substantially constant ignition temperature will operate over a voltage range of 20–28 volts with a power input of less than 12 watts. Under such conditions, the igniter temperature will reach approximately 1500° C. Preferably, the lead wires 30 and 32 are made of stainless steel, stainless steel being the preferred material because a suitable connection can be made between it and the silicon carbide fiber. The electrical connection between the stainless steel lead wires and the silicon carbide igniter element may be made by any conventional process for attaching lead wires to the silicon carbide material. However, the preferred method for effecting this connection is to form the ends of the stainless steel lead wires into a spiral, place a piece of aluminum stock inside the spiral, heat the spiral until the aluminum is in a plastic state, and insert the end of the silicon carbide element axially into the spiral and allow the aluminum to solidify.

The sensing electrode 16 can be formed from any number of suitable materials, the selection of which should be obvious to those skilled in the art. Two of the many suitable materials are stainless steel and KANTHAL A-1 an iron, chromium, aluminum alloy available from the Kanthal Corporation, Bethel, Connecticut. The lead wire 22, of course, must be selected to be of compatible material, stainless steel being the preferred material. Electrical connections between the lead wire 22 and sensing electrode 16 and terminal 34 will be dictated by the particular materials being used. If the lead wire is stainless steel and the sensing electrode of stainless steel or KANTHAL A1, the electrical connection may be made by crimping or welding the lead wire to a suitable integral tab located in the interior of the electrode. Connections between the stainless steel lead wire and terminal 34 which may be brass, phosphor bronze or other suitable materials is made by crimping or welding.

Figure 2:
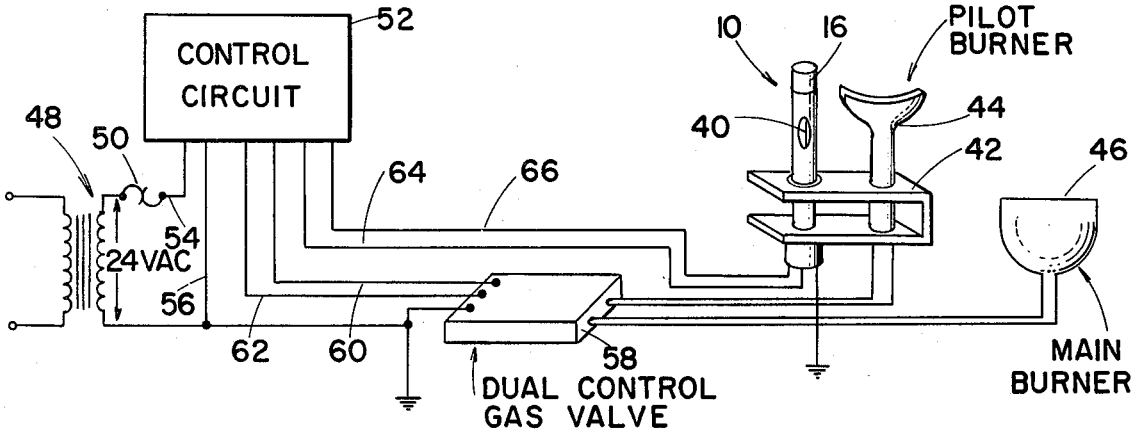
FIG. 2 is a schematic drawing of an ignition system employing the combination igniter-flame sensor assembly in accordance with the present invention.

In FIG. 2 the igniter and flame sensor assembly 10 of the invention is shown in a typical installation mounted on a common bracket 42 along with a pilot burner 44 which is situated to ignite a main burner 46. Inasmuch as the igniter-flame sensor assembly 10 is specifically designed to be mounted on a bracket in place of a thermocouple, the bracket 42 is of conventional design. As a result the igniter-flame sensor assembly is ideally suited for retrofit electrical ignition systems as well as for original equipment.

A typical electrical ignition system is illustrated in FIG. 2 and includes a conventional stepdown transformer 48 having a 24 volt AC output. A conventional thermostatic switch 50 controls application of power to a control circuit 52 which serves to energize a pilot valve and igniter element 40 and then to energize a main valve after a pilot flame has been sensed by flame sensing electrode 16. More particularly, power is applied to control circuit 52 by lead wires 54 and 56 connected to the secondary of transformer 48. A dual control gas valve 58 having a pilot valve and main valve includes a grounded terminal, a pilot terminal to which a pilot lead wire 60 from the control circuit is connected and a main terminal to which a main valve lead wire 62 from the control circuit is connected. The dual control gas valve is a conventional component which supplies gas from a source (not shown) to pilot burner 44 when a continuous signal is applied on line 60 and gas to the main burner 46 when a continuous signal is applied on line 62. In addition, control circuit 52 applies a signal to igniter element 40 on a lead wire 64 connected to terminal 36 so as to cause it to resistively heat to the ignition temperature. Terminal 38 connected to the igniter element is suitably grounded. Furthermore, a lead wire 66 is connected between the control circuit 52 and terminal 34 to provide a connection to the flame electrode 16.

Operation of the ignition system of FIG. 2 should be clear to those skilled in the art inasmuch as the system is conventional in operation. For sake of clarity, however, a brief operating sequence will be described. When thermostat 50 closes, power will be supplied to control circuit 52 which will provide a signal on line 60 to energize the pilot valve and line 64 to energize the igniter element 40. When the igniter element 40 reaches ignition temperature, the pilot burner will be ignited. The pilot flame is arranged to impinge on flame electrode 16 and inasmuch as the pilot burner is grounded (through the dual control gas valve), control circuit 52 will sense the pilot flame as a result of the flame ionization property. Once the pilot flame has been established and sensed, the control circuit 52 will act to energize the main valve.

The preferred form of the invention has been described. Obvious modifications will occur to those skilled in the art. Accordingly, it is intended that the scope of the invention be defined in the claims and not be limited to the foregoing description.

What is claim is:

1. An igniter and flame sensor electrode assembly for igniting and sensing a flame at a fuel burner, which comprises:
   - a housing having a flame ignition port therein extending into the interior of said housing;
   - a resistive igniter element mounted in the interior of said housing, with at least a portion of said igniter element being situated in said flame ignition port for exposure to fuel issuing from said burner;
   - a flame sensing electrode mounted upon the exterior of said housing; and
   - electrical connection means in the interior of said housing for making electrical connections to said igniter element and flame sensing electrode.

2. The igniter and flame sensor electrode assembly as claimed in claim 1, wherein said housing comprises:
   - a pair of mated housing halves which form an elongated tubular housing portion.

3. The igniter and flame sensor electrode assembly as claimed in claim 2 wherein said flame sensing electrode comprises a sleeve mounted upon said tubular housing portion.

4. The igniter and flame sensor assembly as claimed in claim 3, wherein said electrical connection means comprises:
   - a first lead wire electrically and mechanically connected to said flame sensing electrode,
   - second and third lead wires electrically and mechanically connected to opposite ends of said igniter element;
   - said first, second, and third lead wires extending axially through said elongated tubular housing portion; and
   - electrical terminals mounted on said housing and electrically connected to said lead wires.

5. In a heating device having a main burner, a continuously burning pilot burner assembly including a pilot burner in close proximity to said main burner, a thermocouple in close proximity to said pilot burner, and a bracket upon which said pilot burner and thermocouple are mounted, a combination igniter flame sensor electrode assembly adapted to be mounted on said bracket in place of said thermocouple to enable said heating device to be converted to an automatic electrically ignited pilot relight system, which comprises:
   - a tubular housing having a lateral flame ignition port therein and mounted on said bracket in place of said thermocouple;
   - an igniter element mounted in the interior of said housing, at least a portion of said igniter element being situated in said flame ignition port for exposure to fuel issuing from said pilot burner;
   - a flame sensing electrode mounted directly upon said tubular housing;
   - electrical connection means in the interior of said housing for making electrical connections to said igniter element and flame sensing electrode.

6. The igniter flame sensor assembly as claimed in claim 5, wherein said tubular housing comprises:
   - a pair of mated housing halves.

7. The igniter-flame sensor assembly as claimed in claim 6 wherein said flame sensing electrode comprises:

an electrically conductive sleeve surrounding said tubular housing.

8. The igniter flame-sensor assembly as claimed in claim 7, wherein said housing has a plurality of axially extended bores therein; and said electrical connection means comprises a first lead wire situated in one of said bores and electrically connected to said sleeve, second and third lead wires situated in second and third bores respectively, said second and third lead wires being electrically connected, respectively to opposite ends of said igniter element.

* * * * *